US008164565B2

(12) United States Patent
Tsou et al.

(10) Patent No.: US 8,164,565 B2
(45) Date of Patent: Apr. 24, 2012

(54) DISPLAY APPARATUS AND DRIVING METHOD FOR DISPLAY PANEL

(75) Inventors: Yuan-Hsin Tsou, Kaohsiung County (TW); Wen-Hsiung Liu, Pingtung County (TW); Chien-Kuo He, Taipei County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 0 days.

(21) Appl. No.: 13/082,414

(22) Filed: Apr. 8, 2011

(65) Prior Publication Data

US 2011/0181563 A1 Jul. 28, 2011

(30) Foreign Application Priority Data

Mar. 5, 2007 (TW) ..... 96107471 A

(51) Int. Cl.
*G09G 3/36* (2006.01)

(52) U.S. Cl. ..... 345/103; 345/87

(58) Field of Classification Search ..... 345/87, 345/93, 94, 98–100
See application file for complete search history.

(56) References Cited

U.S. PATENT DOCUMENTS

| | | | | |
|---|---|---|---|---|
| 4,842,371 | A * | 6/1989 | Yasuda et al. | 345/96 |
| 5,949,396 | A * | 9/1999 | Lee | 345/87 |
| 6,075,505 | A * | 6/2000 | Shiba et al. | 345/87 |
| 6,583,777 | B2 * | 6/2003 | Hebiguchi et al. | 345/92 |
| 6,809,719 | B2 * | 10/2004 | Wu et al. | 345/103 |

* cited by examiner

*Primary Examiner* — Ricardo L Osorio
(74) *Attorney, Agent, or Firm* — Jianq Chyun IP Office

(57) ABSTRACT

A display apparatus and the driving method thereof are provided. The display apparatus includes a display panel and a gate driver electrically connected to the display panel. The display panel has N scan units. Here, N is a positive integer, and each of the scan units has a first scan line and a second scan line. The gate driver provides N gate control signals to the scan units. The i-th gate control signal corresponds to the i-th scan unit, and i is less than N. When the i-th gate control signal and the (i+1)-th gate control signal are simultaneously enabled, the pixel elements corresponding to the first scan line and the second scan line of the i-th scan unit are simultaneously scanned. When the i-th gate control signal is enabled, the pixel elements corresponding to the first scan line of the i-th scan unit are scanned.

10 Claims, 4 Drawing Sheets

DISPLAY APPARATUS AND DRIVING METHOD FOR DISPLAY PANEL

CROSS-REFERENCE TO RELATED APPLICATION

This is a divisional application of and claims the priority benefit of prior application Ser. No. 11/871,143, filed on Oct. 11, 2007, now allowed. The prior application Ser. No. 11/871,143 claims the priority benefit of Taiwan application serial no. 96107471, filed on Mar. 5, 2007. The entirety of each of the above-mentioned patent applications is hereby incorporated by reference herein and made a part of this specification.

BACKGROUND OF THE INVENTION

1. Field of the Invention

The invention relates to a display apparatus and a display method for a display panel. The display apparatus and the display method can reduce the amount of gate control signals.

2. Description of Related Art

Along with the high resolution development tendency of a TFT-LCD, more scan lines are required to be disposed on a display panel. Meanwhile, more gate driving ICs are needed to provide gate control signals, which result in an increasing design cost of the driving ICs.

In the prior art, since the gate control signals and the scan lines are configured in one-to-one manner, the gate driving circuit needs to provide a same number of gate control signals for driving the scan lines correspondingly. Thus, the fan out area served for connecting the gate terminals and the scan lines (or termed as gate lines) in the panel would become more tight and congested with an increasing number of scan lines, which would increase parasitic capacitance and parasitic impedance. On the other hand, in order to meet the design requirement of light, thin and small, the space within a panel assigned to dispose the fan out area is further shrunk. However, to reduce the influence of parasitic capacitance and parasitic impedance, a sufficient space for wiring of signal and the layout thereof is needed; more tight the layout of a circuit is, the more sensitive the circuit is to the generated parasitic capacitance to affect the display quality.

The US patent publication No. US2006/0022202 provides a scheme to reduce the number of gate control signals by half by using a control circuit, but it requires an additional control circuit to perform the switching of driving signals, which results in an increasing design cost.

SUMMARY OF THE INVENTION

Accordingly, the invention is directed to a display apparatus, wherein each gate control signal correspond to two scan lines and a renewed scanning manner is adopted to achieve the display function of a display panel. Thus, the quantity of the employed gate driving circuits and the layout space of the fan out area is thereby reduced.

The invention is also directed to a driving method suitable for driving an LCD panel, wherein a plurality of scan lines is simultaneously scanned, and the individual scan lines is repeatedly updated. In this way, a fewer number of gate control signals are needed to control more scan lines for accomplishing a normal frame display.

As embodied and broadly described herein, the invention provides a display apparatus, which includes a display panel and a gate driver. The display panel has N scan units, wherein N is a positive integer, the i-th scan unit has a first scan line and a second scan line, i is a positive integer and i=N. The gate driver is electrically connected to the display panel to provide N gate control signals to the corresponding scan units, wherein the i-th gate control signal corresponds to the i-th scan unit.

When the i-th gate control signal and the (i+1)-th gate control signal are enabled at a same time, the pixel elements respectively corresponding to the first scan line and the second scan line of the i-th scan unit are simultaneously scanned; and when the i-th gate control signal is enabled, only the pixel element corresponding to the first scan line of the i-th scan unit is scanned.

Moreover, the invention provides a driving method suitable for driving a display panel, wherein the display panel has N scan units, the i-th scan unit includes a first scan line and a second scan line, $0<i<N$, and i is a positive integer. The driving method includes following steps: sequentially providing N gate control signals to the scan units, wherein the i-th gate control signal corresponds to the i-th scan unit; simultaneously enabling the i-th gate control signal and the (i+1)-th gate control signal, so as to simultaneously scan the pixel elements respectively corresponding to the first scan line and the second scan line of the i-th scan unit and to output the pixel data corresponding to the second scan line to the pixel elements respectively corresponding to the first scan line and the second scan line; and enabling the i-th gate control signal so as to renew scan the pixel element corresponding to the first scan line of the i-th scan unit to update the pixel data corresponding to the first scan line.

The invention utilizes a gate control signal to interactively control scan lines, so that a plurality of scan lines is able to simultaneously conduct scanning, and updating of individual scan lines. Thus, fewer gate control signals are capable to control more scan lines and thereby reduce the quantity of the gate driving circuits and the layout space of the fan out area.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
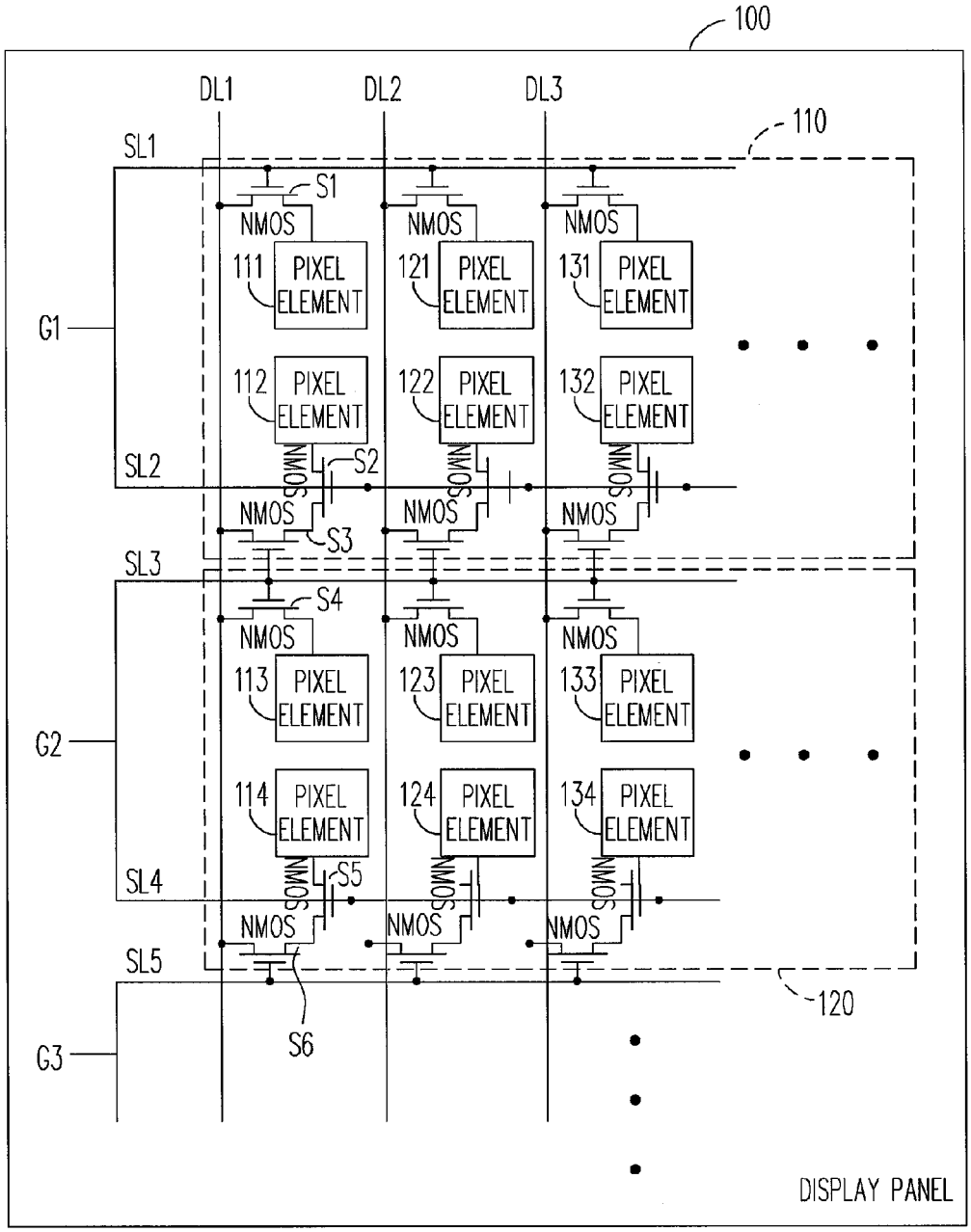
FIG. 1 is a display panel diagram according to an embodiment of the invention.

Reference will now be made in detail to the present embodiments of the invention, examples of which are illustrated in the accompanying drawings. Wherever possible, the same reference numbers are used in the drawings and the description to refer to the same or like parts.

FIG. 1 is a display panel diagram according to an embodiment of the invention. A display panel 100 includes a plurality of scan units, however in FIG. 1, only scan units 110 and 120 are illustrated to exemplarily depict the spirit of the invention. Each of the scan units includes two scan lines and each scan line corresponds to a plurality of pixel elements. The plurality of pixel elements of the display panel 100 is arranged, for example, in an array, and each pixel element corresponds to a scan line and a data line. For example, a first pixel element 111 (pixel element 111 for short) corresponds to a data line DL1 and a first scan line SL1. During scanning a pixel element, i.e. the pixel element is started up, the corresponding data line outputs corresponding pixel data to the started pixel element. In addition, the display panel 100 of the present embodiment is, for example, a liquid crystal display (LCD) panel.

The scan unit 110 includes a first scan line SL1 and a second scan line SL2. The first scan line SL1 is employed for controlling a first switch S1 (in the embodiment, S1 is implemented by an NMOS transistor, wherein the gate thereof is the control terminal of the first switch S1), and the first switch S1 is electrically connected between the first pixel element 111 and the data line DL1. The second scan line SL2 is employed for controlling a second switch S2, and the second switch S2 is electrically connected between a second pixel element 112 (pixel element 112 for short) and a third switch S3, wherein another terminal of the third switch S3 is electrically connected to the data line DL1.

The third switch S3 is controlled by a third scan line SL3 which is disposed in the scan unit 120 and electrically connected to the control terminal of the third switch S3. The first scan line SL1 and the second scan line SL2 are electrically connected to a first gate control signal G1 (gate control signal G1 for short), and the third scan line SL3 is electrically connected to a second gate control signal G2 (gate control signal G2 for short), wherein the first scan line SL1 is adjacent to the second scan line SL2, while the second scan line SL2 is adjacent to the third scan line SL3. The scan unit 120 has a circuit architecture similar to the scan unit 110, the third scan line SL3 is employed for controlling a fourth switch S4 and the fourth switch S4 is electrically connected between a third pixel element 113 (pixel element 113 for short) and the data line DL1. In addition, a fourth scan line SL4 is employed for controlling a fifth switch S5, the fifth switch S5 is electrically connected between a fourth pixel element 114 (pixel element 114 for short) and a sixth switch S6, another terminal of the sixth switch S6 is electrically connected to the data line DL1 and the sixth switch S6 is controlled by a fifth scan line SL5 of the next scan unit. Analogically for the rest, every scan unit has similar circuit architecture, and the number of scan lines depends on the required resolution of the display panel 100.

In the display panel 100, each scan unit corresponds to a gate control signal, that is, every two scan lines are electrically connected to a gate control signal; thus, the display panel 100 in the embodiment requires only half the number of the gate control signals to accomplish the scan operations and display of frames. Although the above description is for the data line DL1 and the corresponding scan lines only, but the rest data lines in the display panel 100 (for example, data lines DL2 and DL3) have a circuit architecture similar to the data line DL1, and the description thereof is omitted.

The scan operation of the invention is described as follows. When the gate control signal G1 is enabled, the switch (for example, S1) of the pixel element (for example, 111) corresponding to the scan line SL1 is turned on, and the data lines (for example, DL1-DL3) would write pixel data into the pixel elements (for example, 111, 121 and 131) on the scan line SL1. When the gate control signals G1 and G2 are simultaneously enabled, the data lines would simultaneously output pixel data to the pixel elements (for example, 111-131, 112-132 and 113-133) respectively corresponding to the first scan line SL1, the second scan line SL2 and the third scan line SL3 (scan lines SL1, SL2 and SL3 for short), that is, the pixel elements (for example, 111-131, 112-132 and 113-133) respectively corresponding to the scan lines SL1, SL2 and SL3 are scanned. During the scanning, first, the gate control signals G1 and G2 are enabled, the data lines output the pixel data corresponding to the scan line SL2 and the pixel elements (for example, 111-131, 112-132 and 113-133) of the scan lines SL1-SL3 would simultaneously receive the pixel data from the data lines. Next, the gate control signal G1 is enabled again (or the gate control signal G1 is disabled) for scanning again the pixel elements (for example, 111-131) corresponding to the scan line SL1 in the scan unit 110, that is, the pixel data corresponding to the scan unit SL1 is overridden, and the scan operations of the scan lines SL1 and SL2 are completed. It can be seen that each scan line (for example, SL1, SL2 or SL3) corresponds to a plurality of pixel elements, and herein three pixel elements (for example, 111-131, 112-132 or 113-133) correspond to a scan line. Analogically for the rest, the scan operations for more than three pixel elements can be obtained and the description thereof is omitted.

Further, the gate control signals G2 and G3 are enabled to scan the pixel elements (for example, 113-133 and 114-134) of the third scan line SL3 and the fourth scan line SL4. In the same way, by using a manner that every two adjacent gate control signals interactively control scan lines, a plurality of scan lines may be capable of simultaneously scanning the corresponding pixel elements and then an individual scan line performs an updating operation, so as to gradually complete the scan operations of the entire frame. Anyone skilled in the art would be able to deduce the scan operations for other scan lines, and the description thereof is omitted.

Figure 2:
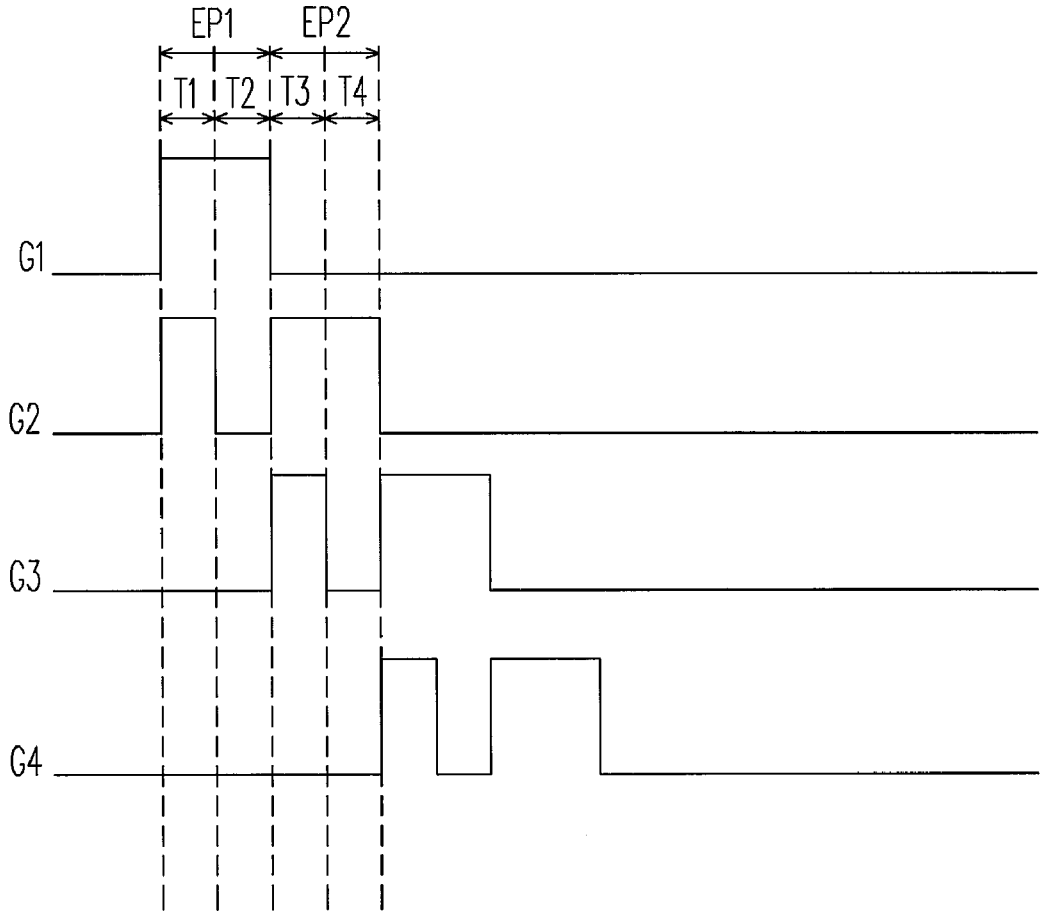
FIG. 2 is a waveform diagram of the gate control signals according to an embodiment of the invention.

The major scan manner of the embodiment can be further explained with the signal waveforms. FIG. 2 is a waveform diagram of the gate control signals according to the embodiment of the invention. Referring to FIGS. 1 and 2, first, an enabling duration EP1 of the gate control signal G1 can be divided into a first enabling duration T1 and a second enabling duration T2. In the first enabling duration T1, the gate control signals G1 and G2 are simultaneously enabled, and the data lines at this time output the pixel data corresponding to the scan line SL2 to the pixel elements (for example, 111-131, 112-132 and 113-133) corresponding to the scan lines SL1-SL3. Next, in the second enabling duration T2, only the gate control signal G1 continues to be enabled, the data lines at this time output the pixel data corresponding to the scan line SL1 to the pixel elements (for example, 111-131) of the scan line SL1, so as to update the data stored in the pixel elements (for example, 111-131) of the scan line SL1. Thus, the scan operations of the scan lines SL1 and SL2 are completed. In the same way, an enabling duration EP2 of the gate control signal G2 can be divided into a first enabling duration T3 and a second enabling duration T4. In the first enabling duration T3, the gate control signal G3 is enabled and the gate control signal G3 is disabled in the second enabling duration T4. For the rest gate control signals, the scan operations are conducted in the same manner, i.e., in an interactive scan manner, to complete scanning the entire display panel.

In the present embodiment, by using every two adjacent gate control signals to interactively control scan lines, that is, a plurality of scan lines scans the corresponding pixel elements first and then individual scan lines gradually perform updating operations, so as to complete the scan operations of the entire frame. Since every two scan lines in the invention require a gate control signal only, thus, the number of the connection terminals (bonding pads) between the panel and the gate driver is reduced, which relaxes the tight and congested situation of the fan out area where the gate connectors and the scan lines in the panel are connected to each other, and this may reduce the possibility of the normal display quality from being influenced by parasitic capacitance or parasitic impedance.

Figure 3:
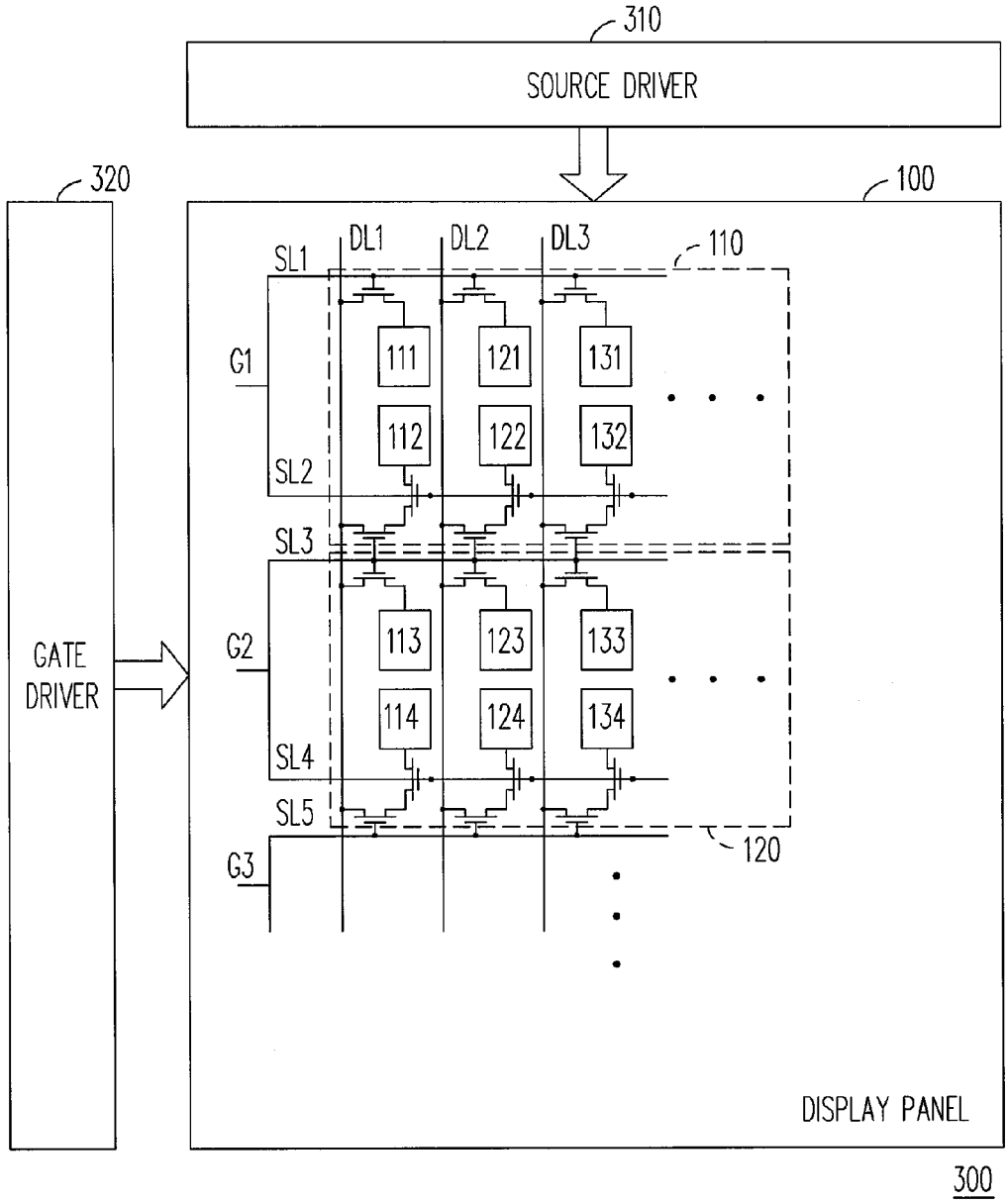
FIG. 3 is a display apparatus diagram according to an embodiment of the invention.

FIG. 3 is a display apparatus diagram according to an embodiment of the invention. A display apparatus 300 includes a source driver 310, a gate driver 320 and a display panel 100. The gate driver 320 is electrically connected to the display panel 100 for providing gate control signals (for example, G1-G3). The source driver 310 is electrically connected to the display panel 100 for providing pixel data to the pixel elements (for example, 111-131, 112-132 and 113-133) in the panel via data lines (for example, DL1-DL3). The display panel 100 has N scan units where N is a positive integer. Each scan unit has two scan lines corresponding to a same gate control signal; assuming the scan lines of the i-th scan unit are a first scan line and a second scan line (i is a positive integer and i is less than N), then, the i-th gate control signal corresponds to the i-th scan unit. In other words, if the i-th scan unit is the scan unit 110, then, the (i+1)-th scan unit is the scan unit 120, and if the i-th gate control signal is the gate control signal G1, then, the (i+1)-th gate control signal is the gate control signal G2. In the i-th scan unit (the scan unit 110) herein, the first scan line is SL1 and the second scan line is SL2; in the (i+1)-th scan unit (the scan unit 120), the first scan line is SL3 and the second scan line is SL4, and analogically for the rest. In the present embodiment, the i-th scan unit 110 is exemplarily explained.

When the i-th gate control signal G1 and the (i+1)-th gate control signal G2 are simultaneously enabled, the pixel elements (for example, 111-131 and 112-132) corresponding to the first scan line SL1 and the second scan line SL2 of the i-th scan unit 110 are simultaneously scanned. When only the i-th gate control signal G1 is enabled, the pixel elements (for example, 111-131) corresponding to the first scan line SL1 of the i-th scan unit 110 is scanned. Therefore, in order to scan the pixel elements (for example, 111-131 and 112-132) of the i-th scan unit 110, first, the i-th gate control signal G1 and the (i+1)-th gate control signal G2 are enabled to simultaneously scan the first scan line SL1 and the second scan line SL2 in the i-th scan unit 110; then, only the i-th gate control signal G1 is enabled to scan the first scan line SL1 in the i-th scan unit 110. The scan manner of the display panel 100 is the same as the above embodiment described with reference to FIG. 1, and therefore the description thereof is not repeated.

The N-th scan unit corresponds to the N-th gate control signal. In order to scan the scan lines in the N-th scan unit, an (N+1)-th gate control signal is additionally disposed in the display panel 100; or the N-th gate control signal directly controls the pixel elements in the N-th scan unit.

Figure 4:
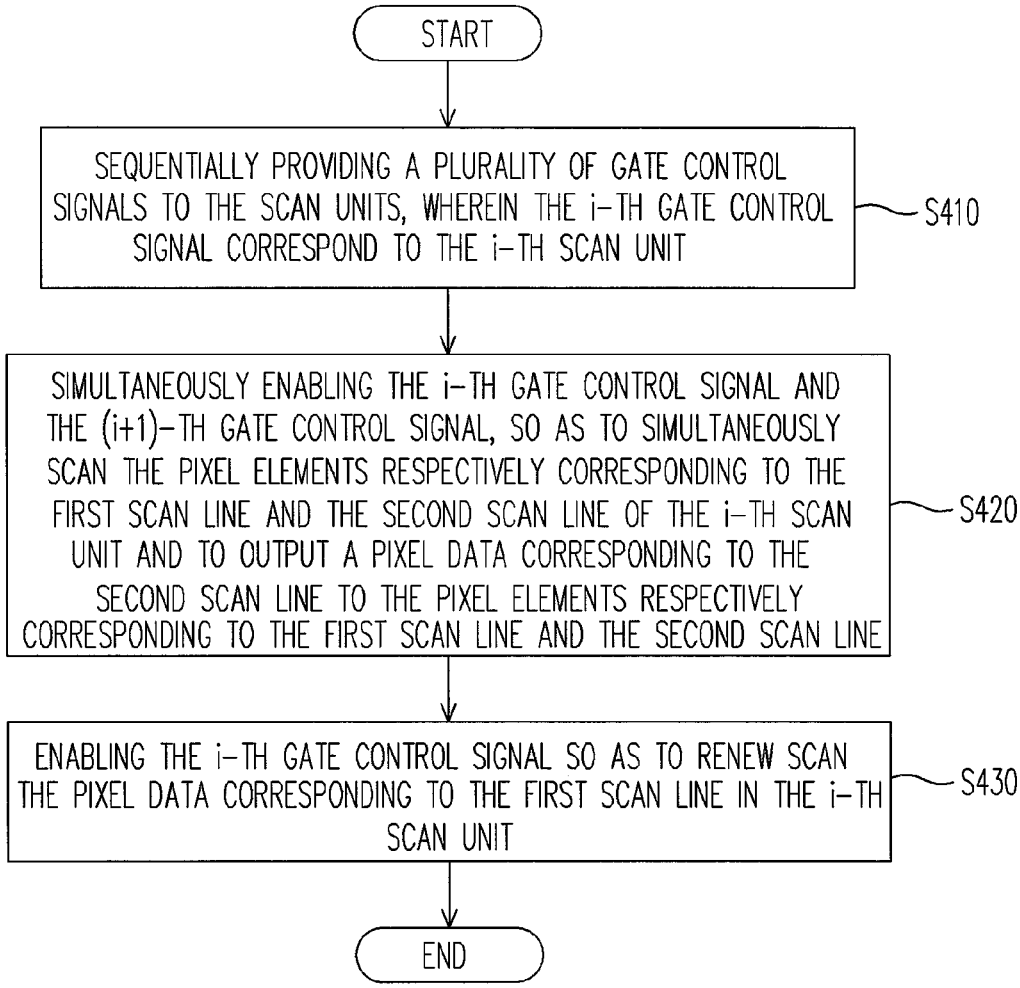
FIG. 4 is a flowchart of the driving method according to an embodiment of the invention.

Furthermore, the invention provides a driving method suitable for the above-mentioned display panel 100. FIG. 4 is a flowchart of the driving method according to an embodiment of the invention. Referring to FIGS. 3 and 4, in step S410, N gate control signals are sequentially provided to the scan units (for example, 110 and 120) in the display panel 100, wherein the i-th gate control signal corresponds to the i-th scan unit. Next, in step S420, the i-th gate control signal and the (i+1)-th gate control signal are simultaneously enabled, so as to simultaneously scan the pixel elements respectively corresponding to the first scan line and the second scan line of the i-th scan unit, and the pixel data corresponding to the second scan line is output to the pixel elements respectively corresponding to the first scan line and the second scan line.

Next, in step S430, the i-th gate control signal is enabled so as to renew scan the pixel elements corresponding to the first scan line in the i-th scan unit and to thereby update the pixel data corresponding to the first scan line. Furthermore, all the scan lines in the display panel 100 are sequentially scanned by following steps S420 and S430 to complete the scan operations of a frame. For more details regarding the driving method, one may refer to the above embodiments described with reference to FIGS. 1-3.

In addition, in the embodiment of the driving method, the N-th scan unit corresponds to the N-th gate control signal. In order to scan the scan lines in the N-th scan unit, an (N+1)-th gate control signal is additionally disposed in the display panel 100; or the N-th gate control signal directly control the pixel elements in the N-th scan unit, which are the same as the driving manner of FIG. 3, and description thereof is omitted.

The invention employs different switch components disposed between scan lines, the gate control signal can simultaneously scan a plurality of scan lines through different circuitries and then the pixel data on the individual scan lines are repeatedly updated, wherein every two scan lines require a gate control signal only. Therefore, only half the number of the gate control signals is required to control more scan lines in a display panel for completing a normal frame display. Since a less number of gate control signals are required according to the invention, the number of gate circuits may be correspondingly reduced, and thereby reduce occupation of the layout space required by the fan out area and decrease parasitic capacitance. Thus, the circuit design cost may be effectively reduced, and the frame display quality may be effectively promoted.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A display apparatus, comprising:

a display panel, having N scan units, wherein N is a positive integer and each of the scan units has a first scan line and a second scan line; and a gate driver, electrically connected to the display panel, for providing N gate control signals to the scan units, wherein an i-th gate control signal of the gate control signals corresponds to an i-th scan unit of the scan units, and i is less than N;

wherein when the i-th gate control signal and the (i+1)-th gate control signal are simultaneously enabled, the pixel elements corresponding to the first scan line and the second scan line of the i-th scan unit are simultaneously scanned; when the i-th gate control signal itself is enabled, the pixel elements corresponding to the first scan line of the i-th scan unit are scanned.

2. The display apparatus according to claim 1, wherein when the N-th gate control signal is enabled, the pixel data are outputted to the pixel elements corresponding to the N-th scan unit.

3. The display apparatus according to claim 1, wherein an enabling duration of the i-th gate control signal is divided into a first enabling duration and a second enabling duration, the (i+1)-th gate control signal is enabled in the first enabling duration and disabled in the second enabling duration.

4. The display apparatus according to claim 1, wherein the i-th scan unit comprises:

a first switch, electrically connected between a first pixel element and a data line, wherein the control terminal of the first switch is electrically connected to the first scan line; and a second switch, electrically connected between a second pixel element and a third switch, wherein a terminal of the third switch is electrically connected to the data line, the control terminal of the second switch is electrically connected to the second scan line, and the control terminal of the third switch is electrically connected to a third scan line of the (i+1)-th scan unit;

wherein the first scan line and the second scan line are electrically connected to the i-th gate control signal, the third scan line is electrically connected to the (i+1)-th gate control signal, the first scan line is adjacent to the second scan line and the second scan line is adjacent to the third scan line.

5. The display apparatus according to claim 4, wherein the third scan line is employed for controlling a fourth switch, and the fourth switch is electrically connected between a third pixel element and the data line.

6. The display apparatus according to claim 4, wherein when the i-th gate control signal is enabled, the first switch is turned on so as to enable the first pixel element to receive the pixel data outputted from the data line.

7. The display apparatus according to claim 4, wherein the first switch, the second switch and the third switch are respectively formed by a transistor and the gate of the transistor is the control terminal.

8. A driving method, suitable for a display panel, wherein the display panel comprises N scan units, each of the scan units comprises a first scan line and a second scan line, and N is a positive integer; the driving method comprising:

sequentially providing N gate control signals to the scan units, wherein the i-th gate control signal corresponds to the i-th scan unit, i is a positive integer and i is less than N;

simultaneously enabling the i-th gate control signal and the (i+1)-th gate control signal, so as to simultaneously scan the pixel elements respectively corresponding to the first scan line and the second scan line of the i-th scan unit and to output a pixel data corresponding to the second scan line to the pixel elements respectively corresponding to the first scan line and the second scan line; and enabling the i-th gate control signal itself so as to rescan the pixel elements corresponding to the first scan line in the i-th scan unit to update the pixel data corresponding to the first scan line in the i-th scan unit.

9. The driving method according to claim 8, wherein the step of simultaneously enabling the i-th gate control signal and the (i+1)-th gate control signal further comprises:

scanning the pixel elements corresponding to a third scan line of the (i+1)-th scan unit.

10. The driving method according to claim 8, further comprising:

outputting the pixel data to the pixel elements corresponding to the N-th scan unit when the N-th gate control signal is enabled.

* * * * *